United States Patent [19]

Kaufman

[11] 4,021,511

[45] May 3, 1977

[54] FUEL DISTRIBUTOR APPARATUS FOR PLUG-TYPE CARBURETOR

[75] Inventor: Warren F. Kaufman, Santa Ana, Calif.

[73] Assignee: Ford Aerospace & Communications, Dearborn, Mich.

[22] Filed: Feb. 12, 1976

[21] Appl. No.: 657,670

[52] U.S. Cl. ..... 261/44 A; 261/79 R; 261/DIG. 78

[51] Int. Cl.[2] ..... F02M 9/14

[58] Field of Search ..... 261/DIG. 78, 44 A, 79 R

[56] References Cited

UNITED STATES PATENTS

| | | | |
|---|---|---|---|
| 1,234,401 | 7/1917 | Shakespear, Jr. et al. | 261/44 A |
| 1,793,556 | 2/1931 | Moore | 261/79 R |
| 1,927,090 | 9/1933 | Hess | 261/79 R |
| 3,301,537 | 1/1967 | De Rugeris | 261/79 R |
| 3,332,231 | 7/1967 | Walsh | 261/79 R |
| 3,778,038 | 12/1973 | Eversole et al. | 261/DIG. 78 |
| 3,849,086 | 11/1974 | Johnson | 261/79 R |
| 3,875,266 | 4/1975 | Fonagy | 261/79 R |

FOREIGN PATENTS OR APPLICATIONS

| | | | |
|---|---|---|---|
| 2,201,607 | 8/1972 | Germany | 261/DIG. 78 |
| 374,806 | 5/1923 | Germany | 261/79 R |
| 411,538 | 8/1945 | Italy | 261/79 R |
| 406,499 | 3/1934 | United Kingdom | 261/79 R |

*Primary Examiner*—Tim R. Miles
*Attorney, Agent, or Firm*—Robert E. McCollum; Keith L. Zerschling

[57] ABSTRACT

A sonic flow, plug type carburetor has an annular fuel induction slot in the outer periphery of the plug connected to an air/fuel mixture supply in the plug, and fuel distribution means in the plug in the form of a vortex chamber located adjacent the slot and receiving liquid fuel therein to centrifuge the fuel outwardly towards the slot in a thin film uniformly around the annulus of the slot.

4 Claims, 3 Drawing Figures

FUEL DISTRIBUTOR APPARATUS FOR PLUG-TYPE CARBURETOR

My copending application, Ser. No. 649,378, Louis Frank Heilig and Warren Frederick Kaufman, filed Jan. 15, 1976, *Sonic Flow Variable Area Venturi Carburetor*, fully describes and shows a variable area venturi, sonic flow, plug type carburetor for accurately controlling the air/fuel ratio of the mixture flow to the engine. This invention is an improvement on that carburetor, and especially in the manner and apparatus for uniformly distributing the fuel into the air stream.

In the above mentioned application, an air/fuel mixture is inducted from an annular slot in the plug into the high/sonic velocity zone of the air metering nozzle. Because of the construction, however, the fuel particles follow a tortious path before entering the air stream. This invention is directed to an apparatus that provides atomization of the fuel globules and, more importantly, evenly distributes the fuel around the annulus of the induction slot for uniform induction into the high velocity air stream and into the engine manifold.

It is a primary object of the invention, therefore, to provide a plug type carburetor with a novel fuel distributing apparatus.

It is another object of the invention to provide a carburetor of the plug type with an air and fuel mixing and distributing means.

It is a still further object of the invention to provide a plug type carburetor with a vortex chamber in the plug connected to an induction slot opening into a high velocity air stream, and into which is discharged an air/fuel mixture, the vortex chamber creating a spinning motion to the mixture by means of ambient pressure air connected to tangential inlets to the vortex chamber to centrifuge the heavier fuel particles outwardly to the induction slot and uniformly around the anmulus of the slot for presentation to the high velocity zone.

Figure 1:
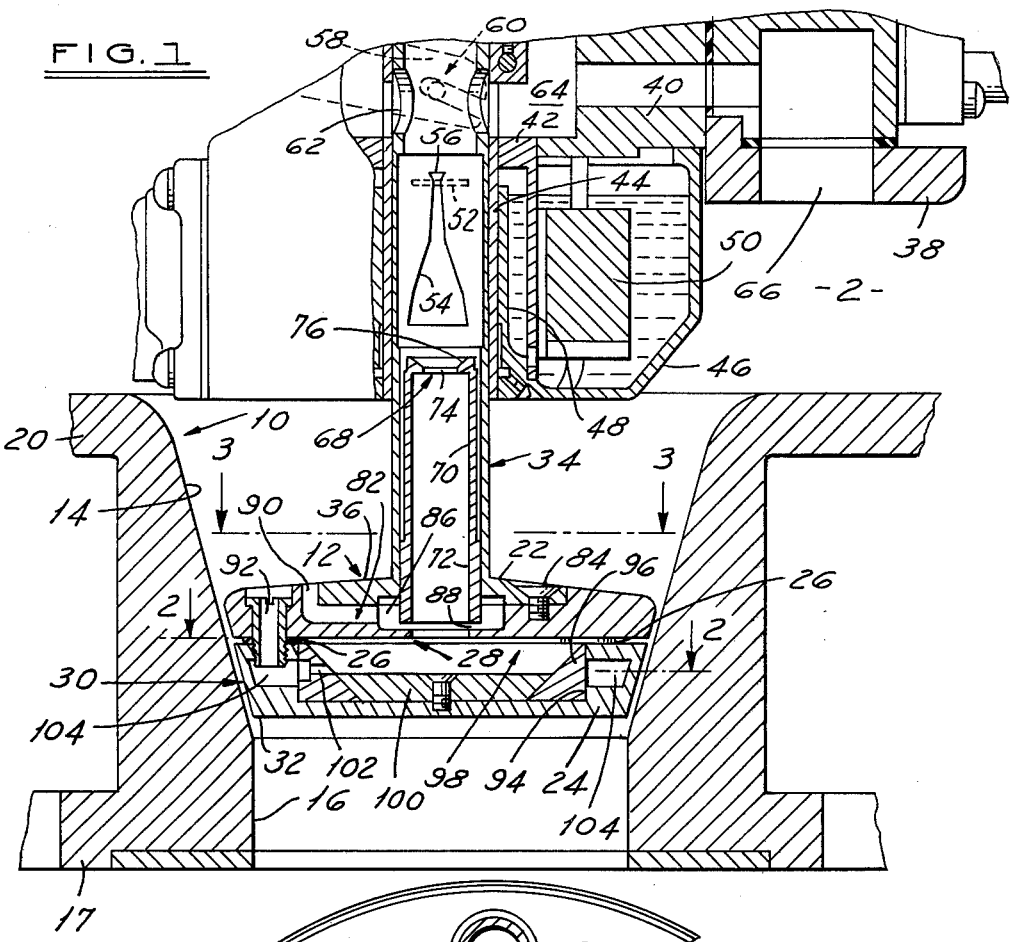
Figure 2:
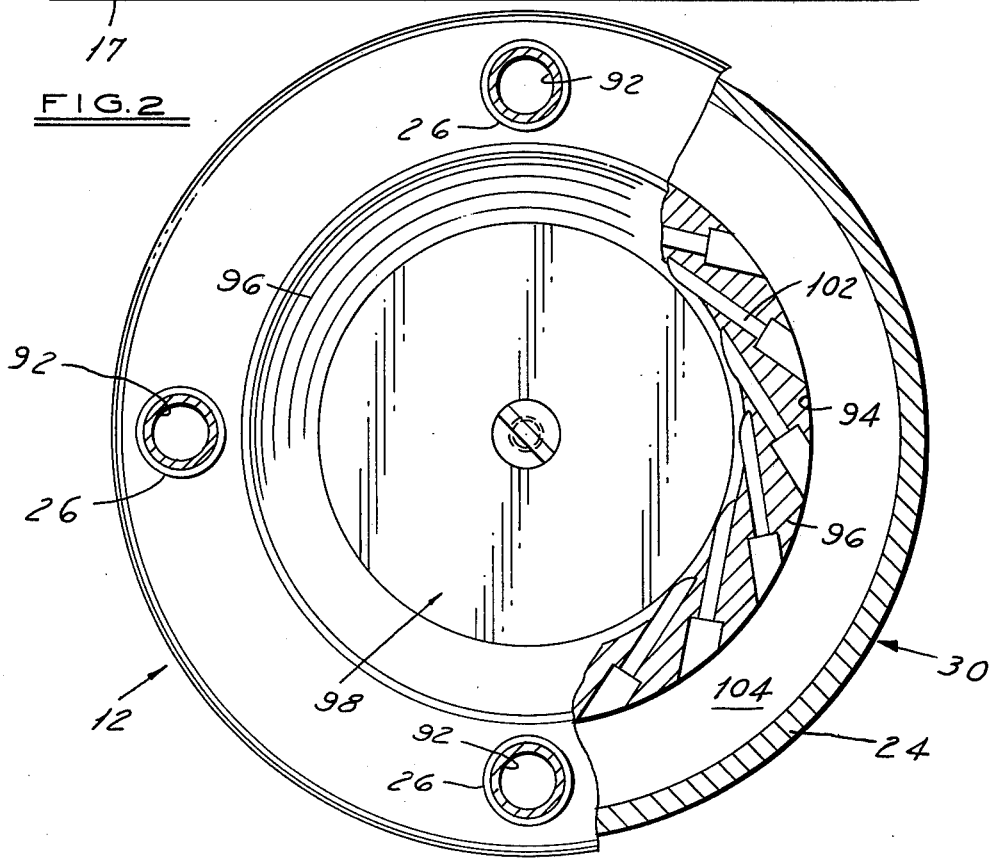
Figure 3:
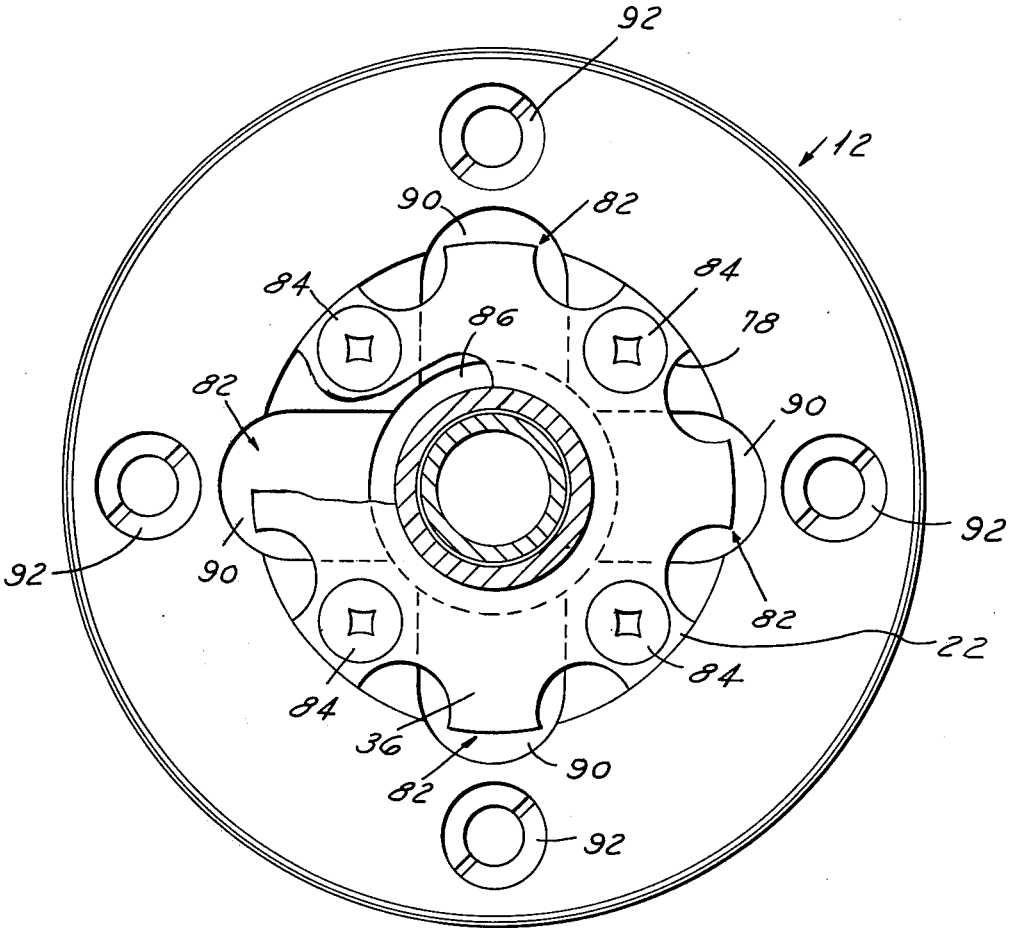

Other objects, features and advantages of the invention will become more apparent upon reference to the succeeding detailed description thereof, and to the drawings illustrating the preferred embodiment thereof; wherein, FIG. 1 is a cross-sectional view of a portion of a carburetor assembly embodying the invention;

FIG. 2 is a cross sectional view, with parts broken away and in section, taken on a plane indicated by and viewed in the direction of the arrows 2—2 of FIG. 1; and FIG. 3 is a plan view of a portion of the carburetor assembly shown in FIG. 1.

FIG. 1 shows a portion of a carburetor assembly of the downdraft induction type. It would include the usual dry element type air cleaner, not shown, surrounding an inlet section 2 of the carburetor for supplying clean air at ambient pressure level to the same. The carburetor consists of a conically shaped air nozzle 10 having a bore defining an induction passage and in which is mounted a matching cone shaped pintle or plug 12. The plug can move vertically to meter air flow through the nozzle, and fuel is supplied through the plug to the induction passage for combination with the metered air flowing into the engine intake manifold.

The air nozzle 10 is defined, for example, by a 15° half angle entrance cone 14 followed by a 2½ inches diameter cylindrical portion 16, and has annular mounting flanges 18 and 20 at opposite ends. The lower flange 18 is adapted to be mounted over and connected to the intake manifold of an internal combustion engine. Portion 14 defines an air inlet that converges towards the manifold.

The pintle or plug 12 is a matching cone that can bottom in the nozzle cone 14 to shut off air flow. The plug is made in two pieces, an upper body 22 and a lower body 24, that are bolted together with an annular spacer element 26 between. The spacer defines an annular metering slot, port or clearance 28 through which an air/fuel mixture is inducted into the high velocity zone or constricted area 30 that is formed between the plug and nozzle when the plug is opened, as will be explained later. The plug is in the shape of an inverted truncated cone having a conical surface that mates with the conical surface of the nozzle to define a diffuserless nozzle. The like tapers of the plug and nozzle permit easy initial alignment of the plug in the nozzle, a simplicity to the construction, and an elimination of the need for air seals. Once the plug is closed, all air flow is shut off.

With no effective diffuser to the nozzle, the flow characteristics through the zone 30 between the nozzle and plug, therefore, is similar to that of a simple orifice; that is, the flow is at sonic velocity so long as the pressure in the intake manifold remains less than 0.528 of the air inlet pressure at the inlet to the nozzle, which is assumed to be atmospheric, and the throat or zone velocity slowly decreases below sonic as the manifold pressure increases above 0.528 atmospheric. The point of highest or maximum velocity, however, of the primary air flow will always be at the bottom edge 32 of the conical plug because of the sudden expansion down stream thereof, regardless of whether the nozzle is choked, i.e., at sonic velocity, or not.

The plug 12 includes a centrally located, hollow stem portion or tube 34 that projects axially upwardly from plug 12 and is fixed to it by an annular flange 36. Tube 34 is mounted in general for a vertical sliding movement within an upper mounting flange 38. The mounting flange is secured to an annular casting 40 within which is secured an annular cup-shaped cylinder 42 opening towards the bottom. Within the cylinder is fixed a sleeve 44 in which is slidably mounted the tube 34.

The assembly just described is located vertically with respect to the air nozzle 10 by means of four circumferentially spaced dowels, not shown, that are seated between flanges 30 and 18, and bolted in place. The spacing provided by the dowels defines the annular air passage or primary air inlet 2 in the air cleaner assembly.

The single fuel metering system now to be described is constructed to cause a change in fuel flow that is proportional to changes in the air metering flow volume upon movement of plug 12. That is, the change in metering area divided by the plug stroke is a constant. This is accomplished by having a portion of the fuel metering element move with plug 12, and its particular geometric construction.

More specifically, the hollow stem portion 34 of plug 12 contains the fuel metering system. Secured to the bottom of casting 40 is a cup-like, donut-shaped fuel float bowl 46. The bowl has a radially inner wall 48 formed as a sleeve, and sealingly engages sleeve 44. Casting 40 serves not only as a cover for the float bowl, but also has a support for the conventional fuel supply mechanism, which includes an annular float 50. The float operates in a known manner. Lowering of the fuel level in the float bowl causes a dropping of float 50 to permit fuel to be added to the bowl from a supply source, not shown. Alternately, rise of the fuel to the level shown will raise the float to block off the fuel inlet.

As best seen in FIG. 1, the stationary guide sleeve 44 surrounding the upper end of tube 34 has a pair of diametrically opposed, narrow cross slots 52 that extend circumferentially as shown. Only one slot is shown, for clarity. Slots 52 are located above the level of the fuel in the float bowl, and constitute fuel induction ports. Coacting with the cross slots 52 are a pair (only one shown) of diametrically opposed, circumferentially and axially extending, tapered fuel metering slots 54 cut in the sides of tube 34. The slots 54 are shown as diverging towards the manifold or in the direction of the plug 12, and have a somewhat Christmas-tree shape. The slots 54 are shaped to provide a constant air/fuel ratio of, say, 15 to 1, for example, for all positions of the plug except at wide open throttle, when it is shaped to richen the ratio. More specifically, the Christmas-tree shaped slots 54 have a initial minimum flow area 56, which when aligned with the cross slot 52 provides the low fuel flow requirements necessary for engine idel speed operation. The remaining increasingly larger areas shown provide progressively greater fuel flow in secheduled porportion to the increase in air flow upon the raising of plug 12, to maintain the air/fuel ratio constant. When the plug 12 is in its downwardmost position shutting off air flow, the metering slots 54 will be below cross slots 52. The solid wall portion of sleeve 44 then will shut off all fuel flow.

To insure that the fuel flow will vary as a function of the change in the air metering flow volume, the lower end of tube 34 is mechanically locked to the air metering upper plug portion 22. Opening the air meter, therefore, opens up the connection of the fuel metering slots 54 to cross slots 52, and the matching of the air meter and fuel meter provides an air/fuel mixture ratio that will be constant over the major portion of the plug stroke range.

Plug 12 is moved to provide greater or less air and fuel flow volumes to satisfy all engine requirements while at the same time attempting to maintain the nozzle in as close to a critical flow mode as possible. This is desirable because operating in choked flow mode provides maximum metering accuracy. This is accomplished by connecting the plug 12 through mechanical linkage to the conventional driver actuated accelerator pedal. In brief, the upper end of metering tube 34 is connected to the yoke shaped end 58 of a lever 60 that is pivotally connected through other linkage not shown to the accelerator pedal, also not shown. Depression of the accelerator pedal, therefore, pulls metering tube 34 and plug 12 upwardly to open the air meter to not only increase the area of zone 30 but also the fuel metering area of slot 54 with respect to slot 52, for a greater induction of fuel.

As described, the main fuel metering system defined by the metering slots 54 maintain an essentially constant air/fuel ratio at all operating stages except at wide open throttle. Since the air/fuel ratio should change according to engine requirements, to provide cold enrichment, etc., for example, some means must be provided to varying the air/fuel ratio when desired. This is accomplished by a secondary air bias circuit that in effect spoils or changes the vacuum signal acting through the fuel metering slot 54 on the exposed part of cross slot 52 to change the pressure differential across the slots. More specifically, the upper end of metering tube 34 has a number of large holes 62 that connect the tube to a secondary air chamber 64 formed in casting 40. Chamber 64 receives a supply of air from the primary air supply passage 2 through an opening 66 in flange 38, which opening flows air past a number of control devices, not shown. These controls are fully shown and described in my copending application U.S. Ser. No. 649,378 referred to above, and, therefore, will not be described in detail. Suffice it to say that the controls will vary the amount of secondary air that can flow to chamber 64, i.e., the flow capacity, as a function of ambient temperature conditions and acceleration demand, for example. Controlling the amount of secondary air flow, therefore, will control the air/fuel ratio because for the same vacuum signal acting in tube 34, less air flow will increase fuel flow, and vice-versa.

Further details of construction and operation of the carburetor per se are not given since they are fully shown and discussed in copending U.S. Pat. application Ser. No. 649,378 referred to above, incorporated herein by reference, and are believed to be unnecessary for an understanding of the invention.

Turning now to the fuel distributing apparatus of the invention, the lower end of tube 34 contains a fuel stripper device 68. It consists of a sleeve 70 fixed within tube 34 and open at its bottom 72 to the fuel metering slot or space 28. At its upper end, sleeve 70 is formed with an orifice 74 and a bevelled or conical fuel inlet 76. Any liquid fuel droplets that may tend to collect on the walls of tube 34 if sleeve 70 were not present are stripped off by passage through the conical inlet 76, which directs the air/fuel mixture towards the axis of the tube 34 for entry into the metering slot 28.

The lower end of metering tube 34 has the flange 36 with a scalloped outer edge 78 (FIG. 3). The scallops 80 overlay and cooperate with four radially extending air passages 82 formed in the plug upper body 22, which is attached by screws 84 to flange 86. The upper body and flange are formed further with central recesses to define an air annulus 86 that surrounds the lower end of tube 34. The annulus communicates with the tube interior by way of an annular space or slot 88 of a few hundredths inches thickness, for example, between the tube and upper body. The outer portions 90 of the air passages 82 open through the top of the upper body 22 to be in direct communication with the ambient pressure air in air inlet 2. With high vacuum in tube 34 and slot 28, air then will rush in through passages 82 and slot 88 to strip off any fuel film from the interior wall of tube 34 and drive the fuel towards the center at the end of the tube. This assures that the fuel will not follow the surfaces and run along the ceiling of the induction slot 28.

Additional air also in inducted through the hollow screws 92 that connect upper body 22 to lower body 24. More specifically, lower body 24 is formed with a large centrally located annular pocket 94. Within the pocket is fixed an internally tapered sleeve member 96 that defines a vortex chamber 98. The bottom of chamber 98 is fitted with a splash member 100 screwed to lower body 24. As best seen in FIG. 2, the sleeve member 96 has a number, sixteen in this case, of equally circumferentially spaced air inlet 102. The inlets are tangentially oriented with respect to the outer periphery of the inner chamber 98 defined by member 96 to create a strong vortex action within chamber 98, in a known manner. This will result in a uniform distribution of the fuel around the annular slot 28, as will be explained.

The air is supplied to inlets 102 from a plenum 104 defined by an annulus formed in the outer part of lower body 24. The annulus is open through the interior of the hollow plug body connecting screws (four) 92 to the ambient pressure air in primary air intake passage 2.

As will be evident, the strong suction force exerted in the high or sonic velocity zone 30 upon operation of the engine will cause a high velocity flow of air/fuel mixture down tube 34. The additional air inducted into annulus 86 and through slot 88 will strip off any liquid fuel from the end of tube 34 by the air flowing radially towards the center of the end of the tube, and, therefore, at right angles to the direction of flow of any fuel globules running down the tube walls. This mixture is then discharged directly into the center of the vortex chamber 98. The strong suction force in slot 28 will immediately begin to turn the air molecules towards the zone 30. However, the heavier fuel particles will splash against the member 100 and bounce in all directions, mixing with the air. At the same time, the incoming air jets from the tangential inlets 102 create a swirling or spinning motion within chamber 98, catching up the fuel into a vortex motion.

The internal walls of chamber 98 are shown as tapering or sloping in a diverging manner in the upward vertical direction. Stated conversely, the walls converge towards the manifold. This causes any fuel particles that are swirling around in the vortex motion also to be centrifuged upwardly and radially outwardly towards the induction slot 28. This has the net effect of thinly spreading the fuel in a liquid film around the annulus or around the tapered walls so that the fuel is presented uniformly to the annular slot 38. This centrifuging action provides a finer fuel droplet size and a greater fuel atomization. The more uniform distribution then results in more uniform filling of the manifold with the air/fuel mixture.

While the invention has been shown and described in its preferred embodiment, it will be clear to those skilled in the arts to which it pertains that many changes and modifications may be made thereto without departing from the scope of the invention.

I claim:

1. A carburetor having an induction passage open at one end to a source of air at an ambient pressure level and connected at its opposite end to an engine intake manifold, the passage containing an air and fuel metering conical nozzle portion receiving therein a plug to define between the plug and nozzle a constricted high velocity flow zone, the plug having a peripheral annular air/fuel mixture induction slot communicating with the high velocity zone for the induction of an air/fuel mixture into the engine in response to a vacuum signal generated in the zone upon operation of the engine, air/fuel mixture supply means connected to the plug slot, and fuel distribution means located in the plug in communication with both the air/fuel mixture supply means and the fuel induction slot to uniformly distribute any liquid fuel droplets present in the air/fuel mixture around the annulus of the slot for a uniform distribution into the zone and engine, the fuel distribution means including a vortex chamber having an outlet connected to the induction slot and first tangentially located air inlets connected to the air source for creating a vortex in the chamber, the chamber having another inlet receiving the air/fuel mixture for the intermix of liquid fuel with the vortex air and the swirling of the resulting mixture around the chamber for a uniform distribution around the annulus of the fuel induction slot.

2. A carburetor as in claim 1, including fuel stripper means adjacent the lower end of the tube to detach any liquid fuel clinging to the walls of the tube and direct it into the air/fuel mixture.

3. A carburetor as in claim 2, the fuel stripper means including an annular plenum surrounding the lower end of the tube and means defining an air discharge slot between the end of the tube and the first mentioned conduit means and connected to the plenum for receiving air therefrom and discharging the air radially towards the longitudinal axis of the tube, and additional conduit means connecting the ambient pressure air from above the plug to the plenum.

4. A carburetor having an air/fuel induction passage open at one end to a source of air essentially at atmospheric pressure and connected at its other end to the intake manifold of an internal combustion engine to be subject at all times to the vacuum signal therein to effect air flow thereinto, a variable area venturi in the passage defined by an air nozzle receiving a movable plug therein, movement of the plug defining a variable area constricted high flow velocity fuel atomizing zone between the nozzle and plug, a hollow tube fixed to and projecting upwardly from the plug, means connecting air and fuel to the upper end of the tube, the plug having an annular air/fuel mixture induction port in the periphery of the plug opening into the constricted zone, conduit means connecting the lower end of the tube to the plug induction port, and fuel distributing means in the conduit means between the lower end of the tube and the annular induction port for uniformally distributing the fuel around the port for a uniform induction into the induction passage, the fuel distributing means including tubular means defining a vortex chamber at the discharge end of the tube diverging axially towards the induction port, the tubular means having a plurality of air inlets arranged tangential to the outer periphery of the vortex chamber to provide a vortex motion in the chamber, and second conduit means connecting air to the inlets from the air nozzle at a location above the plug, the vacuum signal at the induction port effecting a downward axial movement of the air/fuel mixture through the tube and an induction of air to the vortex chamber through the inlets followed by a radial movement of the mixture through the induction port, the heavier fuel particles flowing into the chamber and mixing with the air therein and being centrifuged radially outwardly and upwardly towards the induction port by the swirling vortex motion applied thereto.

* * * * *